US005087078A

United States Patent [19]

Phillips

[11] Patent Number: 5,087,078

[45] Date of Patent: Feb. 11, 1992

[54] PROTECTIVE BOOK COVER

[76] Inventor: Geoff Phillips, 6726 Cavite Ct., San Diego, Calif. 92120

[21] Appl. No.: 626,941

[22] Filed: Dec. 13, 1990

[51] Int. Cl.[5] ..... B42D 3/00; B42D 3/18

[52] U.S. Cl. ..... 281/31; 281/29; 281/34; 281/36; 281/37

[58] Field of Search ..... 281/29, 31, 34, 35, 281/36, 37

[56] References Cited

U.S. PATENT DOCUMENTS

| | | | |
|---|---|---|---|
| 3,572,767 | 3/1971 | Learned | 281/29 X |
| 3,833,244 | 9/1974 | Heimann | 281/29 X |
| 3,891,240 | 6/1975 | Du Corday | 281/29 |
| 3,915,778 | 10/1975 | Carter et al. | 281/34 X |
| 4,341,401 | 7/1982 | Arntzen | 281/34 |
| 4,441,950 | 4/1984 | Lolli | 281/29 X |
| 4,477,013 | 10/1984 | Herrin | 281/29 X |
| 4,497,508 | 2/1985 | McHugh | 281/34 |
| 4,744,592 | 5/1988 | Barnette et al. | 281/29 X |
| 4,893,837 | 1/1990 | Pugliese et al. | 281/34 X |
| 4,941,791 | 7/1990 | Iwamoto | 281/29 X |
| 5,004,514 | 4/1991 | Pugliese et al. | 281/29 X |

*Primary Examiner*—Paul A. Bell
*Attorney, Agent, or Firm*—Frank D. Gilliam

[57] ABSTRACT

A protective cover for a book including cover sleeves consisting of two overlaying sheets bonded together along three edges adapted to fit over book covers or the like. Each cover having a plurality of tear away strips along an open end of the sleeve. Each of the strips bearing a line pressure sensitive adhesive overlaid with a removable protective facing. A line of pressure sensitive adhesive is positioned along the closed end opposite the strips and on the same side of the sleeve as the adhesive on the strips. An elongated narrow spine piece adapted to engage a book spine having a plurality of tearaway strips at least on one narrow end of the spine. Lines of pressure sensitive adhesive along the long edges of the spine piece on the same side thereof. Easily removable protective facing on each of the spine adhesive lines. When the cover is installed on a book or the like there is no attachment to the book surface.

11 Claims, 1 Drawing Sheet

PROTECTIVE BOOK COVER

BACKGROUND OF THE INVENTION

This invention relates in general to protective book covers and, more specifically, to book covers adaptable for use with books of a variety of sizes.

Replaceable paper protective covers for books such as school books have long been used. Generally, paper such as kraft paper has been cut to fit a particular book, folded around the book covers and spine and taped or glued in place. While inexpensive, these covers are short lived, tending to fit poorly and tear in use, reducing protection to the book. Also, the title of the book had to be written on the cover to distinguish it from other, similarly covered, books. Further, such covers do not provide note pockets inside the cover and are generally unattractive, hiding the usually more attractive book cover.

Pre-cut, decorative paper and preformed plastic covers are sometimes available. Since each cover is made to fit a specific book size, or a narrow range of sizes, a large number of different sizes must be maintained by suppliers. Also, because of the great variation in book sizes, especially thickness, these covers generally do not fit well and are subject to early wear and tearing. Covers are either too loose, tending to fall off the book, or too tight making closing the book difficult.

Thus there is a continuing need for improved book cover systems providing covers having improved strength and wear resistance and are adaptable for use with books having a wide variety of heights, lengths and thicknesses.

SUMMARY OF THE INVENTION

It is, therefore an object of this invention to provide a protective book cover system adaptable for use with a large variety of book sizes and shapes. Another object of this invention is to provide protective book covers which snugly fit books and improve resistance to wear and tearing. A further object is to provide a book cover which provides note pockets within covers and/or a spine pocket for a spine insert. Yet another object is to provide a quick and easy method for applying a book cover to a book.

The above noted objects, and others, are accomplished in accordance with this invention by a book cover system comprising cover sleeves adapted to cover the front and back covers of a book and a spine piece adapted to cover the book spine and bond to the cover sleeves.

Each cover sleeve comprises a pair of sheets of material such as paper, plastic, leather or the like bonded together along three edges. A plurality of narrow tearaway strips are provided along the open edge of the sleeve. These strips are separated by rows of perforations or other weakened lines which allow one or more strips to be torn away while retaining resistance to inadvertent separation. Areas of pressure sensitive adhesive covered with easily removable protective facings are provided along the tearaway strips and along the opposite edge of the sleeve. In use, a number of strips are removed to make the depth of the sleeve match the width of a book cover. The cover is inserted into a sleeve and moved to the top of the sleeve. The protective facing is removed from the required extent of the adhesive and any excess sleeve extending below the cover is folded upwardly and inwardly of the cover and held in place by the adhesive. This folded material provides a pocket for notes or the like.

An elongated, narrow spine piece is provided having a width sufficient to cover the spine of the selected book and extend over the adjacent cover sleeves. The spine piece may be a single sheet or may be a flattened tube. A number of tearaway strips are provided on at least one narrow end, including rows of perforations allowing selected numbers of strips to be torn away to fit the spine length of the book being covered. Strips of pressure sensitive adhesive are provided along one side adjacent to the long edges of the spine piece. The protective facings on the adhesive are removed and the spine piece is wrapped around the spine with the adhesive in bonding contact with the adjacent edges of the cover sleeves. If the spine piece is in tubular form, a spine insert may be slipped thereinto.

BRIEF DESCRIPTION OF THE DRAWING

Details of the invention, and of a preferred embodiment thereof, will be further understood upon reference to the drawing, wherein.

DETAILED DESCRIPTION OF PREFERRED EMBODIMENTS

Figure 1:
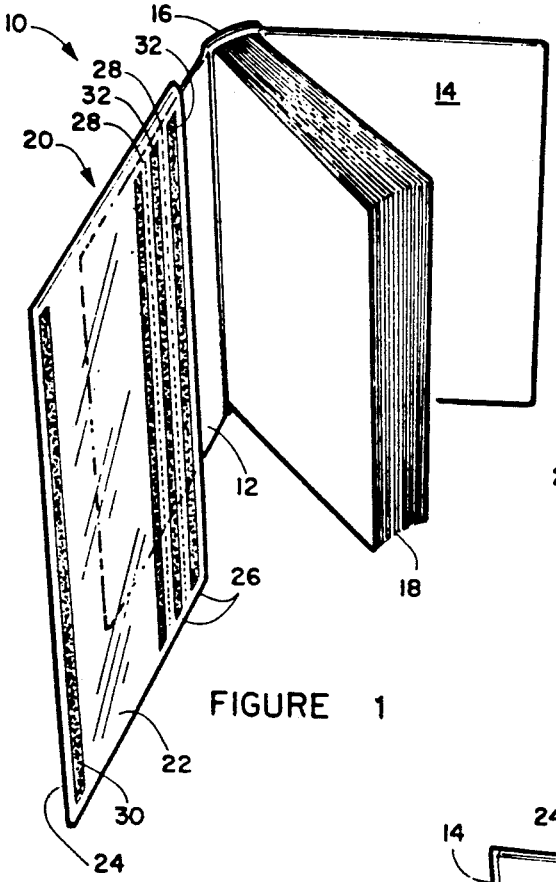
FIG. 1 is a perspective view of a cover sleeve according to this invention being placed over a book cover.

Referring now to FIG. 1, there is seen a book 10 having a front cover 12, a back cover 14, a spine 16 and pages 18.

A cover sleeve 20 is selected which has, initially, a length and width greater than those of front cover 12 and is formed from a front sheet 22 and a rear sheet 24 secured together along three sides as indicated forming a pocket-like sleeve. Sleeve 20 may be formed from any suitable material, such as paper, plastic coated paper, a plastic material such as polyvinyl or polyethylene, leather or any combination thereof. The sleeves can be formed in any suitable manner, such as adhesive bonding of overlapping edges, heat sealing of plastic material or the like.

A plurality of tearaway strips 26 are provided along the open end of sleeve 20 each having a row of perforations 28 allowing separation of strips from the sleeve. While perforations as shown are preferred, other techniques for weakening the material along a line may be used, if desired. For example, if plastic coated paper is used, then merely eliminating the plastic coating along lines corresponding to perforation lines 28 as seen will provide a weakened line for easy, accurate tearing. Perforations 28 are designed to allow the strips to be removed without excessively weakening the cover in that region. Since any perforations or other weakened lines at non-removed strips 26 are adjacent to spine 16, they are in a region that is not subject to great wear, so unremoved perforations do not significantly weaken the sleeve.

A conventional pressure sensitive adhesive is applied to sleeve 20 and covered with a conventional peelable protective facing along a line 30 adjacent to the closed end of sleeve 20 and along lines 32 on each strip 26 and adjacent to the last strip. It is generally preferred that the adhesive lines extend the entire height of the cover sleeve as shown so that each sleeve could be used on either the front or back cover. If desired, the adhesive lines could only extend upwardly from the lower edge of each sleeve to an extent sufficient to accommodate the maximum fold-over (as seen in FIG. 2) anticipated.

When a book 10 is to be covered, a sleeve 20 is held up to the cover 12 and a suitable number of strips 26 are torn away so that the sleeve will surround the cover with the open sleeve end adjacent to spine 16. The cover 12 is then inserted into sleeve 20.

Figure 2:
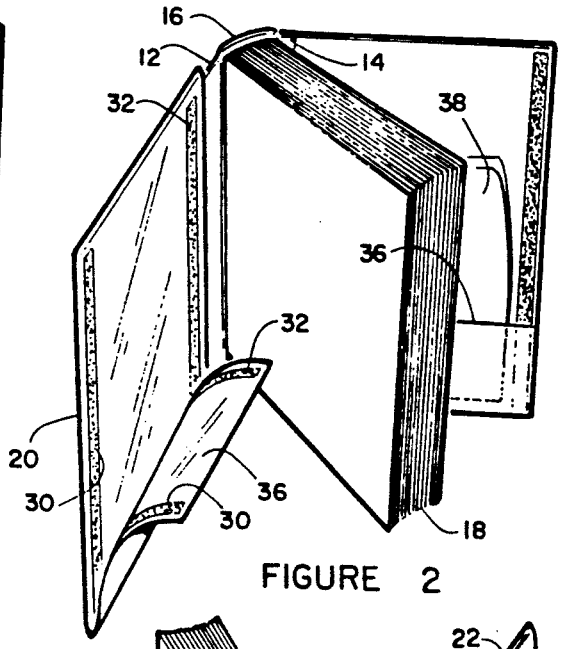
FIG. 2 is a perspective view of a book with two cover sleeves in place.

As shown in FIG. 2, cover 12 is fully inserted into sleeve 20 which is then pulled toward the lower edge of cover 12. A suitable length of the protective facing 50 is removed from the lower ends of adhesive lines 30 and 32 and the excess sleeve material is folded up and bonded by the adhesive, forming a pocket 36 for notes 38 or the like. While only one adhesive line 32 is shown in this illustration, several tearaway strips and corresponding adhesive lines may remain if the book has greater width. Each will have a portion of the protective facing removed and bonded to the pocket material, reinforcing the pocket area. Deeper pockets 36 may be provided, if desired, by selecting sleeves 20 with greater length.

Figure 3:
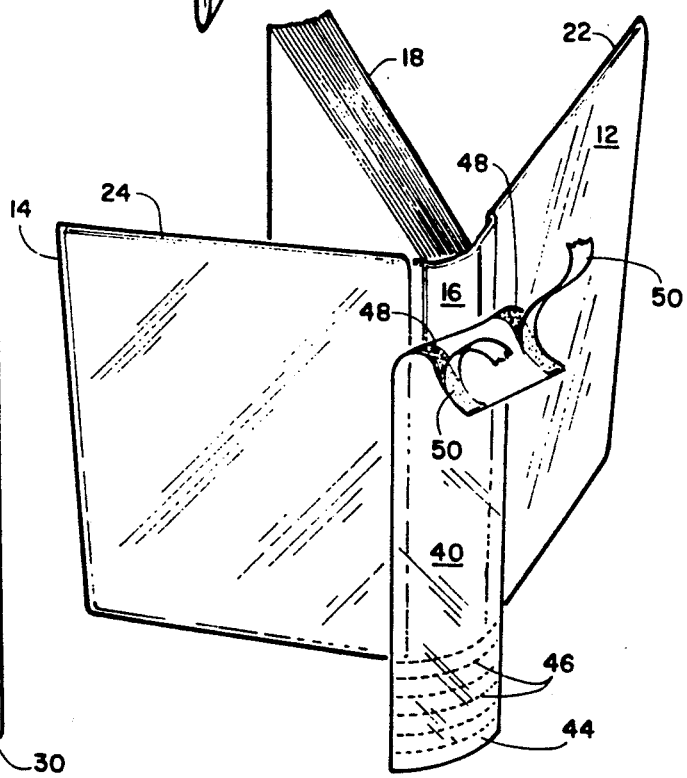
FIG. 3 is a perspective view showing the application of a spine piece to a book being covered.

Once both front cover 12 and back cover 14 have had a sleeve 20 installed, the spine piece 40 is installed as illustrated in FIG. 3. Spine piece 40 includes a sheet or flat tube 42 with a number of tearaway strips 44 at one or both ends, each having a line of perforations 46 or other weakened lines, permitting one or more strips 44 to be easily separated. Each long edge of spine piece 40 has a line of pressure sensitive adhesive 48 along each side covered by a protective facing 50. If desired, spine pieces 40 could be manufactured in long rolls, with each spine piece separated at a weakened line as needed.

The three pieces of the cover of this embodiment may be fabricated as a single sheet with appropriate frangible lines for separating the three separate pieces therefrom.

The spine piece 40 is applied after cover sheets 22 and 24 are placed on the covers. A suitable number of strips 44 are stripped away to make the length of spine piece 40 correspond to the length of spine 16. With the covers open as shown, one protective facing 50 is removed and the adhesive line 48 is pressed against the cover sleeve adjacent to the spine. Then the opposite protective facing is removed, the spine piece 40 is smoothed over spine 16 and the second adhesive line 48 is pressed against the other cover sleeve. When the book is closed, the overall cover is pulled tightly against the covers and spine.

If spine piece 40 is formed from a flattened tube of transparent plastic material, a spine card with selected indicia may be slipped into the tube so as to lie against spine 16 and be visible when the book is placed in a bookcase. Cover sleeves 20 and/or spine pieces 40 may be printed or imprinted with any multi-colored design as desired or may be transparent to allow the book cover to clearly show through.

Figure 4:
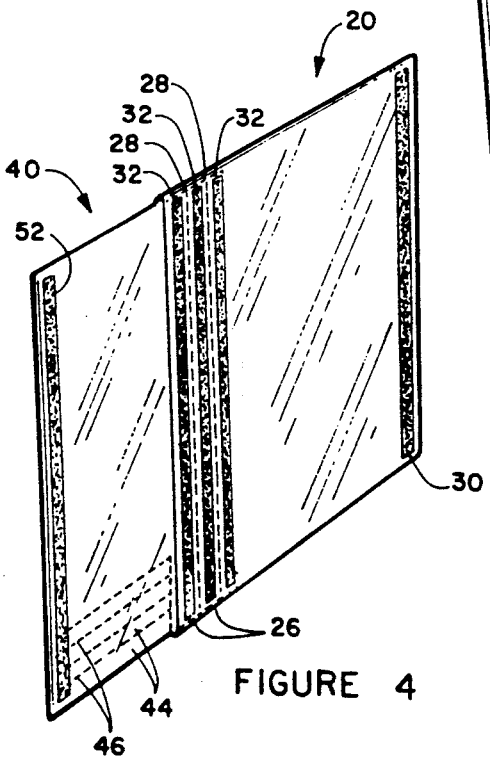
FIG. 4 is a plan view of a cover sleeve with an integral spine piece.

An alternative embodiment of one cover sleeve is illustrated in FIG. 4. In this embodiment, cover sleeve 20 includes an integral spine piece 40 which is an extension of the outer sheet making up sleeve 20. Tearaway strips 26 in this case are bound by a line of perforations 28 on only the inside sheet and the lower portion up to the highest of perforations 46. Each tearaway strip includes an adhesive line 32 and a tearaway strip 30 of the sort described above. In addition, a pressure sensitive line 52 is provided along the inside edge of the extended spine piece 40. A series of tearaway strips 44 are provided along the lower edge of the spine piece 40, each of which has a perforation line 46.

In use, a book cover is inserted into cover sleeve 20 and moved toward the top. A suitable number of strips 26 are torn away, then the lower portion of protective strips on adhesive strips 30 and 32 are removed, so that the extended lower portion of sleeve 30 can be folded up on the inside of the book cover to form a pocket. A suitable number of strips 44 are tornaway so that spine portion 40 fits the book spine. A second cover sleeve 20, of the type shown in FIG. 1 is fitted over the second book cover as detailed above. Then, with the book open as seen in FIG. 3, the protective facing over adhesive line 52 is removed, extended spine portion 40 is stretched and the adhesive line 52 is bonded to the second cover sleeve. While only two pieces are required to form the entire book cover system in this embodiment, it is not quite as widely useable, due to the limit in number of perforations 46 provided and the crossing of perforations 46 and the perforations 28 on the lower outside sheet of sleeve 20 may make installation of the system slightly more difficult.

While certain preferred materials, arrangements and conditions were detailed in the above description of preferred embodiments, those may be varied, where suitable, with similar results. Other variations, applications and ramifications of this invention will occur to those skilled in the art upon reading this disclosure. Those are intended to be included within the scope of this invention, as defined in the appended claims.

I claim:

1. A protective book cover system comprising:

cover sleeves adapted to fit over book covers, each cover sleeve consisting of two overlying sheets bonded together along three edges;

each cover sleeve having a plurality of narrow tearaway strips along the open end of said sleeve;

each of said strips bearing a line of pressure sensitive adhesive overlayed with a removable protective facing;

a line of pressure sensitive adhesive along the closed end opposite said strips, on the same side of said sleeve as said adhesive on said strips;

an elongated narrow spine piece adapted to engage a book spine having a plurality of tearaway strips on at least one narrow end of said spine piece;

lines of pressure sensitive adhesive along the long edges of said spine piece on the same side of said spine piece; and easily removable protective facings on each of said spine piece adhesive lines.

2. The protective book cover system according to claim 1 wherein said cover sleeves and spine piece are formed from a material selected from paper, plastic coated paper, plastic film, leather and combinations thereof.

3. The protective book cover system according to claim 1 wherein said cover sleeves and spine piece are formed from transparent plastic film materials.

4. The protective book cover system according to claim 1 wherein said spine piece is formed from a single sheet of material.

5. The protective book cover system according to claim 1 wherein said spine piece is formed from a flat tube of transparent plastic material.

6. The protective book cover system according to claim 1 including a line of perforations between said tearaway strips.

7. The method of covering a book with a protective cover, said book having front and back covers hingedly connected to a spine, which method comprises the steps of:

providing a cover sleeve consisting of two overlying sheets bonded together along three edges, said sleeves having a plurality of narrow tearaway strips along the open edge wherein a line of perforations is included between each of said tearaway strips, each of said strips and the edge of said sleeves opposite said strips bearing a line of pressure sensitive adhesive with a protective facing over said adhesive, the length of said sleeve opening being greater than the length of the book cover to be covered;

tearing away a suitable number of said tearaway strips so that the width of said sleeves substantially matches the width of the covers to be covered;

inserting each cover into a sleeve with the cover in the upper portion of said sleeve;

removing a portion of the lower adhesive protective facing;

folding the sleeve portion extending below the cover inwardly to overlap the inner sleeve, so that said adhesive bonds the extended portion to said sleeve forming a pocket;

providing an elongated narrow spine piece having a plurality of perforated tearaway strips at one end, lines of pressure sensitive adhesive along the long edges on one surface of said spine piece and a protective facing covering each adhesive line;

tearing away a suitable number of said spine piece tearaway strips to make the length of said spine piece substantially match the length of the book spine;

removing the protective facing from one of the spine piece adhesive lines;

pressing said uncovered adhesive line against a cover sleeve adjacent to said spine;

removing the protective facing from the second spine piece adhesive line; and pressing said second spine piece adhesive line against the second cover sleeve adjacent to said spine.

8. The method according to claim 7 wherein said cover sleeves and spine piece are formed from a material selected from paper, plastic coated paper, plastic film, leather and combinations thereof.

9. The method according to claim 7 wherein said cover sleeves and spine piece are formed from one of a group consisting of opaque and transparent plastic materials.

10. The method according to claim 7 wherein said spine piece is formed from a single sheet of material.

11. The method according to claim 7 wherein said spine piece is formed from a flat tube of transparent plastic material.

* * * * *